US009409196B1

(12) United States Patent
Lucas

(10) Patent No.: US 9,409,196 B1
(45) Date of Patent: Aug. 9, 2016

(54) LIGHT ASSEMBLY FOR SPRAY PAINT GUN

(71) Applicant: Kirk Thomas Lucas, Maize, KS (US)

(72) Inventor: Kirk Thomas Lucas, Maize, KS (US)

( * ) Notice: Subject to any disclaimer, the term of this patent is extended or adjusted under 35 U.S.C. 154(b) by 209 days.

(21) Appl. No.: 14/103,340

(22) Filed: Dec. 11, 2013

Related U.S. Application Data

(63) Continuation-in-part of application No. 13/564,905, filed on Aug. 2, 2012, now abandoned.

(60) Provisional application No. 61/514,328, filed on Aug. 2, 2011.

(51) Int. Cl.
*B25B 23/18* (2006.01)
*B05B 15/00* (2006.01)
*F21V 33/00* (2006.01)

(52) U.S. Cl.
CPC ..... *B05B 15/00* (2013.01); *F21V 33/00* (2013.01)

(58) Field of Classification Search
CPC ..... B05B 15/00; F21V 33/00; F21V 33/0084; B25B 23/18; B25F 5/021; F41G 1/35; Y10S 239/14
USPC ..... 362/109–112, 119–120, 157, 190–191, 362/800; 248/224.8, 225.11, 200, 300
See application file for complete search history.

(56) References Cited

U.S. PATENT DOCUMENTS

| | | | |
|---|---|---|---|
| 3,784,804 | A | 1/1974 | Sabatelli et al. |
| 3,812,340 | A | 5/1974 | Brandt et al. |
| 4,291,839 | A | 9/1981 | Brett |
| 4,912,750 | A | 3/1990 | Foster |
| 5,873,647 | A | 2/1999 | Kurtz et al. |
| 2010/0214768 | A1 | 8/2010 | Dixon et al. |

*Primary Examiner* — Laura Tso
*Assistant Examiner* — Naomi M Wolford

(57) ABSTRACT

A compact light assembly is adapted for use with a spray paint gun. The spray paint gun has a spray gun body and a spray nozzle assembly including a nozzle fitting and a spray nozzle that threads onto the nozzle fitting. The light assembly includes a light bracket, LED lights, a battery pack and a switch. The light bracket has a mounting plate which has an opening for receiving the nozzle fitting of the spray nozzle assembly. The light bracket receives the nozzle fitting and the spray nozzle is threaded onto the nozzle fitting until the mounting plate. The LED lights, the battery pack and the switch are also mounted to the light bracket. The LED lights are arranged around the nozzle and shine light on an area that includes the area receiving paint from the paint gun.

11 Claims, 14 Drawing Sheets

LIGHT ASSEMBLY FOR SPRAY PAINT GUN

RELATED APPLICATIONS

This application is a continuation-in-part of U.S. non-provisional patent application Ser. No. 13/564,905 filed on Aug. 2, 2012, which is incorporated herein by reference.

U.S. Non-provisional patent application Ser. No. 13/564,905 claimed the benefit of U.S. Provisional Patent Application Ser. No. 61/514,328 having an application date of Aug. 2, 2011 which is also incorporate herein by reference.

FIELD OF THE INVENTION

The present invention relates to a light assembly that can be mounted to paint spray gun for illuminating an area being painted by a paint sprayer.

BACKGROUND OF THE INVENTION

The process of spraying paint on a surface, particularly spraying paint on the surface of a vehicle such as an automobile, is a process that requires a high degree of skill if a coating of paint is to be applied to a surface that is uniform and flawless. Typically, the paint is applied using a hand held paint gun that is connected to a pressurized air source so that paint is directed as a pattern of fine paint droplets toward the working surface. As is the case with any such highly skilled effort, it is important that the craftsperson doing the work be able to clearly see the surface as it is being painted. Often in a spray painting process, the surface being painted is illuminated by lights mounted in the paint room. Unfortunately, it is often the case that the painter is positioned between the light source and the surface being painted. This causes a shadow to be cast on the work surface that, in turn, makes it difficult for the painter to visualize the surface as it is receiving paint. What is needed is a lightweight, compact lighting system which can be mounted to a paint gun that will produce a generally uniform field of illumination in an area at least as extensive as the area that is sprayed with paint as the painter moves the paint gun over a workpiece surface.

SUMMARY

The above stated need is addressed by a light assembly for spray paint guns. The light assembly is adapted for mounting to a paint spray gun of the type having a handle, a gravity feeding paint container mounted above the handle having a neck portion that is received by a paint inlet fitting at the top of the handle and a forwardly projecting nozzle assembly including an externally threaded generally cylindrical nozzle portion and a removable internally threaded spray nozzle fitting that threads onto the nozzle portion. The light assembly includes a light bracket, light modules and a power pack. The light bracket is shaped to fit around the paint gun nozzle and includes a generally flat thin mounting plate portion having a generally circular opening that receives the nozzle portion of the spray gun. The light bracket generally hangs on the nozzle portion and is held in place when the spray nozzle fitting is threaded onto the externally threaded nozzle portion. The light bracket includes a top flange that extends back from the top edge of the mounting plate. The rear edge of the top flange of the light bracket has at least one centered scallop that receives the paint inlet fitting at the top of the handle. Thus, when the nozzle fitting is threaded into place, the light bracket is pushed back so that the scallop of the top flange engages the paint inlet fitting. The light modules are secured to the light bracket. A power pack is also secured to the light bracket. In this example, the power pack is also mounted to the light bracket and is adapted to hold standard sized small batteries, such as, for example, a set of AAA batteries. Preferably a switch is provided in a circuit that includes the batteries and the light modules. In this example, the lights include a plurality of compact LED lights that are arranged around the nozzle assembly in light modules and are selected, arranged and oriented to produce a generally uniform area of illumination that encompasses the paint spray pattern area. Accordingly, with the lights activated, the painter is able to easily see the paint as it is sprayed on to a workpiece surface.

DETAILED DESCRIPTION

Figure 1:
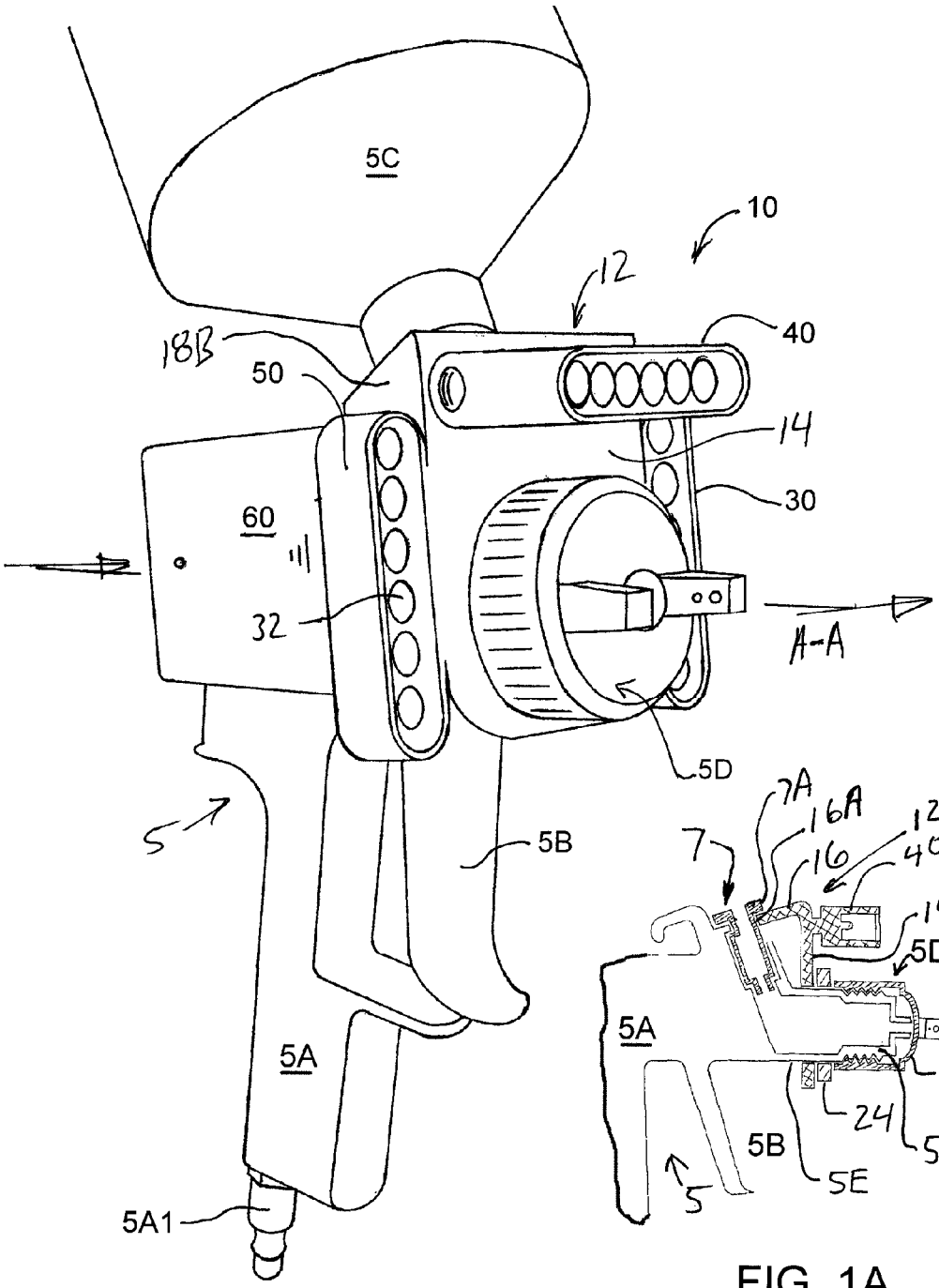
FIG. 1 is a perspective view of the spray paint gun light assembly mounted to a spray paint gun.
Figure 1A:
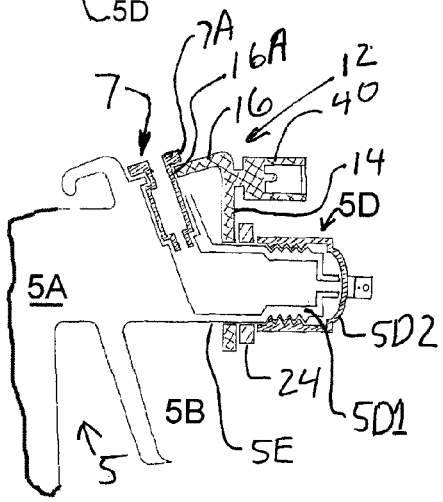
FIG. 1A is a sectional view taken from plane A-A of FIG. 1.

A paint spray paint gun light assembly 10 is shown in FIG. 1 mounted to a paint spray gun 5. As can be seen in FIG. 1, spray paint gun 5 includes a handle 5A which is fed by an air intake fitting 5A1 for receiving pressurized air, a control trigger 5B, a paint container 5C and a spray nozzle 5D. Paint container 5C has a neck portion 5E which is received by a paint inlet fitting 7 located at the upper end of spray paint gun 5 as shown in FIG. 1A. As is well known by those skilled in the art, when an operator depresses trigger 5B, paint draining from container 5C is mixed with pressurized air and ejected through spray nozzle 5D in what is preferably an even, uniform spray pattern suitable for high quality spray painting. This is accomplished when a skilled painter holds handle 5A and depresses trigger 5B while moving spray paint gun 5 in relation to a workpiece surface in a manner that is well known by those skilled in the art of spray painting.

As can be seen in FIG. 1, spray nozzle 5D further includes an externally threaded portion 5D1 and a removable internally threaded nozzle portion 5D2. Nozzle portion 5D2 includes internal threads that match corresponding external threads of threaded portion 5D1. Typically, the paint gun body presents a smooth cylindrical portion 5E (shown in FIG. 1A) that extends back from externally threaded portion 5D1.

Figure 2:
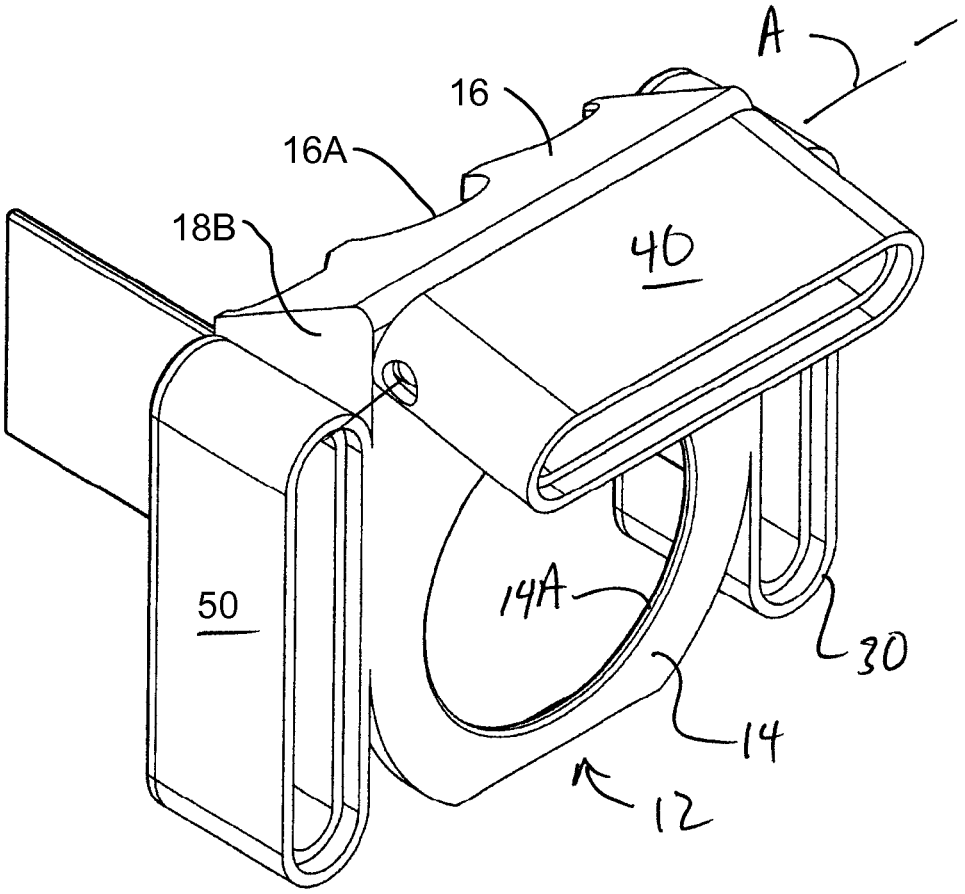
FIG. 2 is a first perspective view of the spray paint gun light assembly.

Light assembly 10 includes a light bracket 12, a first light module 30, a second light module 40 and a third light module 50 and a power pack 60. Light bracket 12 includes a front mounting plate portion 14 which has an opening 14A having an inside diameter that is at least slightly larger than the outside diameter of threaded portion 5D1. Extending back from the top edge of front mounting plate portion 14 is a scalloped top flange 16 that can be best seen in FIGS. 2 and 3. Scalloped top flange 16 has at least one scallop 16A that is shaped to fit against the paint inlet fitting 7 at the upper end of spray gun 5. Accordingly, when light bracket 12 is placed on threaded portion 5D1 and nozzle portion 5D2 is threaded into place, scallop 16A is generally pushed into contact with a radial flange 7A extending from the upper end of paint inlet fitting 7 as shown in FIG. 1A. This mounts light bracket 12 of light assembly 10 to paint spray gun 5 with sufficient stability for ordinary use. As can be seen in FIG. 1A an optional spacer gasket 24 may be installed between front mounting plate portion 14 and nozzle portion 5D2. Further, a series of spacer gaskets 24 of varying thickness may be provided to improve the stability of the mounting of light bracket 12 to spray gun 5.

Figure 3:
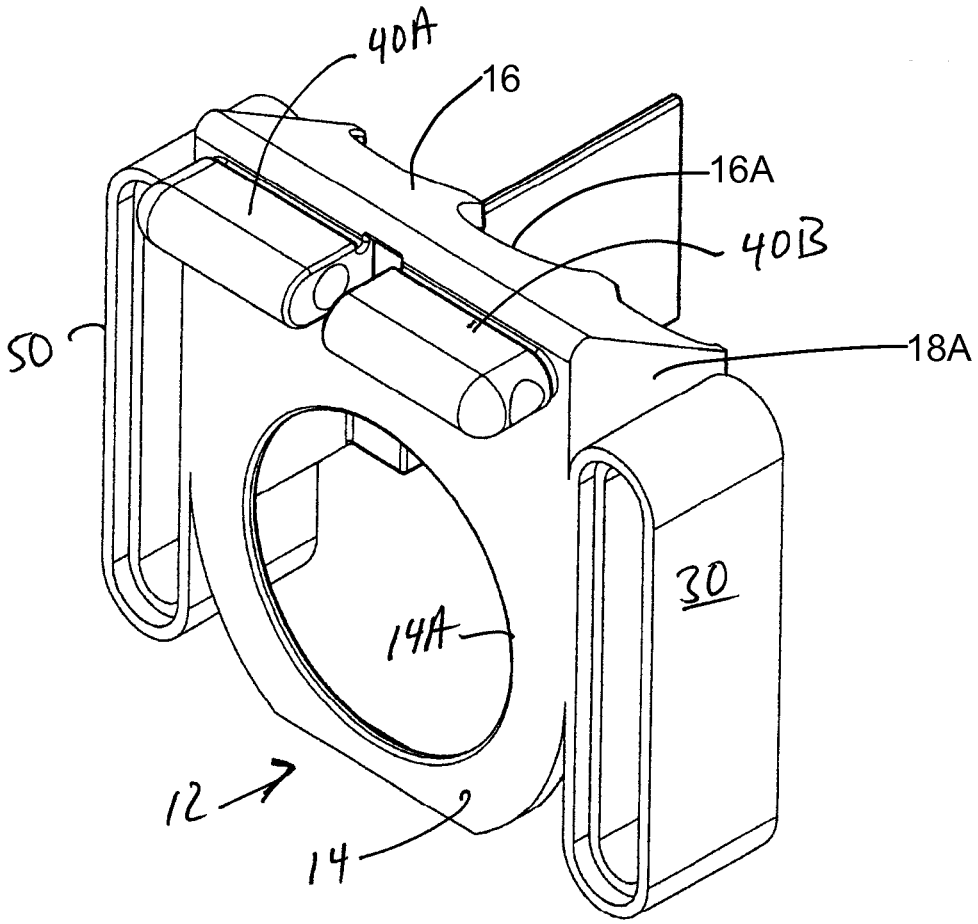
FIG. 3 is a second perspective view of the spray paint gun light assembly showing a second embodiment for the second light module.

As noted above, light assembly 10 includes a first light module 30, a second light module 40 and a third light module 50. First light module 30 is mounted to the left side of light bracket 12 on a left flange 18A that extends between front mounting plate portion 14 and top flange 16. Second light module 40 is mounted to the top edge of light bracket 12 near the top edge of front mounting plate portion 14. Third light module 50 is mounted to the right side of light bracket 12 on a right flange 18B that also extends between front mounting plate portion 14 and top flange 16. In this example, each light module, 30, 40 and 50 includes a linear pattern of lights which are preferably six LED lights 32. In this example, second light module 40 is mounted on a pivot to pivot around axis A indicated in FIG. 1. The pivotable mounting of second light module 40 allows the operator to adjust the direction of the lights of second module 40. In this example, the LED lights 32 of first, second and third light modules 30, 40 and 50 are preferably standard 5 mm LED lights which generally require 3.3 volts and 25 milli-amps Each LED light 32, in this example, produces approximately 7000 mcd (milli-candles) which is approximately 12.9 lumens of light. Light modules 30, 40 and 50 are arranged so that when lights 32 are turned on, a generally uniform dispersed beam of light shines upon the workpiece surface that generally corresponds to and is at least as extensive as the area being sprayed by paint spray gun 5. FIG. 3 provides a view of a second embodiment wherein second light module 40 has been divided into two independently adjustable light modules 40A and 40B. Other LED lights may be selected, at significantly greater costs that generate substantially more light.

Figure 4:
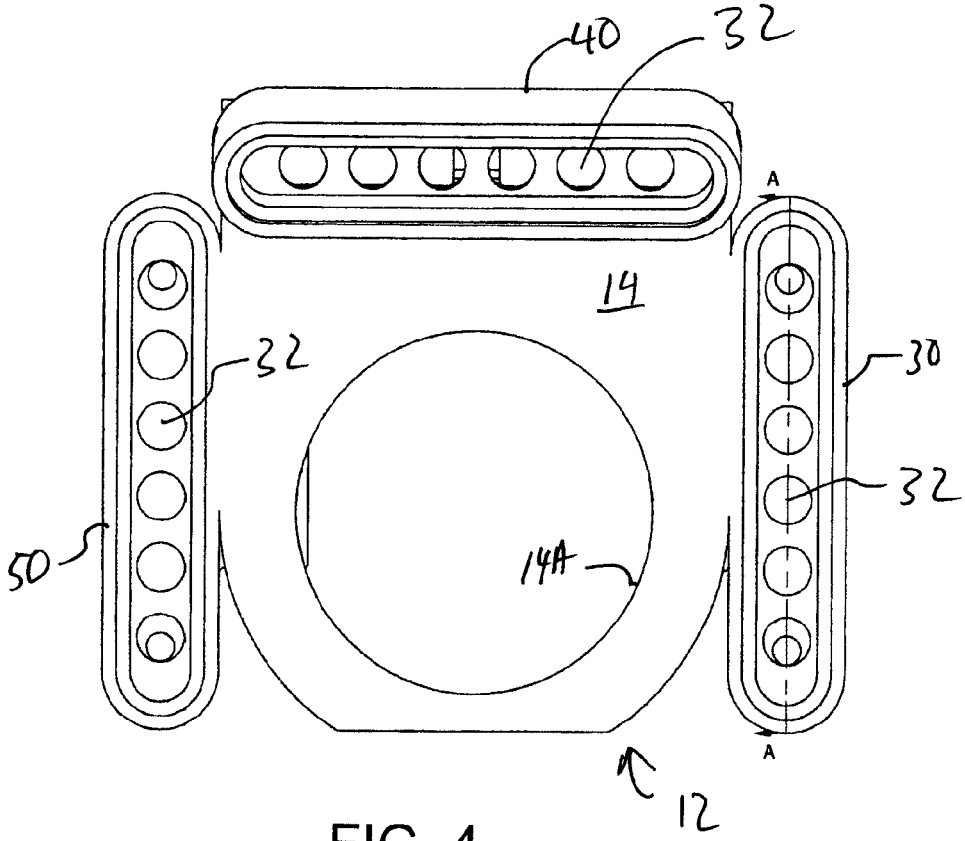
FIG. 4 is a front view of the spray paint gun light assembly.
Figure 4A:
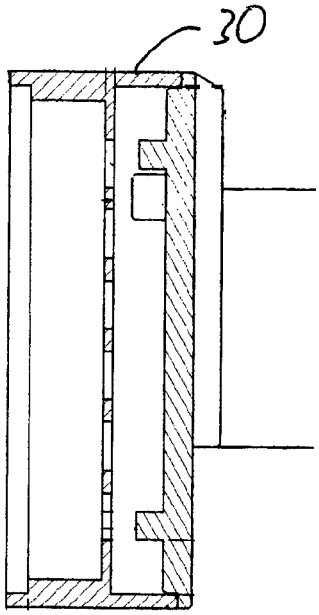
FIG. 4A is a sectional view of one the left side light module taken from plane A-A of FIG. 4.

FIGS. 4 and 4A provide a close up and cut away view of a typical light module. The skilled reader should note that light modules 30, 40 and 50 are preferably fashioned from a lightweight molded plastic or from any other suitable lightweight material such as aluminum. LED lights 32 are also relatively small and light in weight.

A power pack 60 is secured to the light bracket 12, in this example on the right side generally behind third light module 50. In this example, power pack 60 is arranged to carry preferably four (4) standard AAA batteries (not shown) which are sufficient to supply power to light modules 30, 40 and 50 for an extended period of time generally in excess of two hours. It is important for the battery pack 60 to provide sufficient power to power spray paint gun light assembly 10 for a useful period of time. It is also important that battery pack be relatively small and light in weight for the same reasons noted above for light modules 30, 40 and 50. A switch (not shown) is in a circuit with the lights 32 of light modules 30, 40 and 50 so that it is possible to turn lights 32 on and off.

All of the structural portions of light bracket 12, light modules 30, 40 and 50 and power pack 60 may be fashioned from light weight thin walled injection molded or formed plastic or a similar light weight material. Sill further, the batteries of battery pack 60 may also be relatively light weight rechargeable batteries. Accordingly paint gun light assembly 10 may be fashioned so that it adds very little weight to paint gun 5 while providing useful illumination of the workpiece being painted. It is important that paint gun light assembly 10 not add significant weight to paint gun 5 so that a painter may retain substantially the same degree of maneuverability when using paint gun 5.

Figure 5:
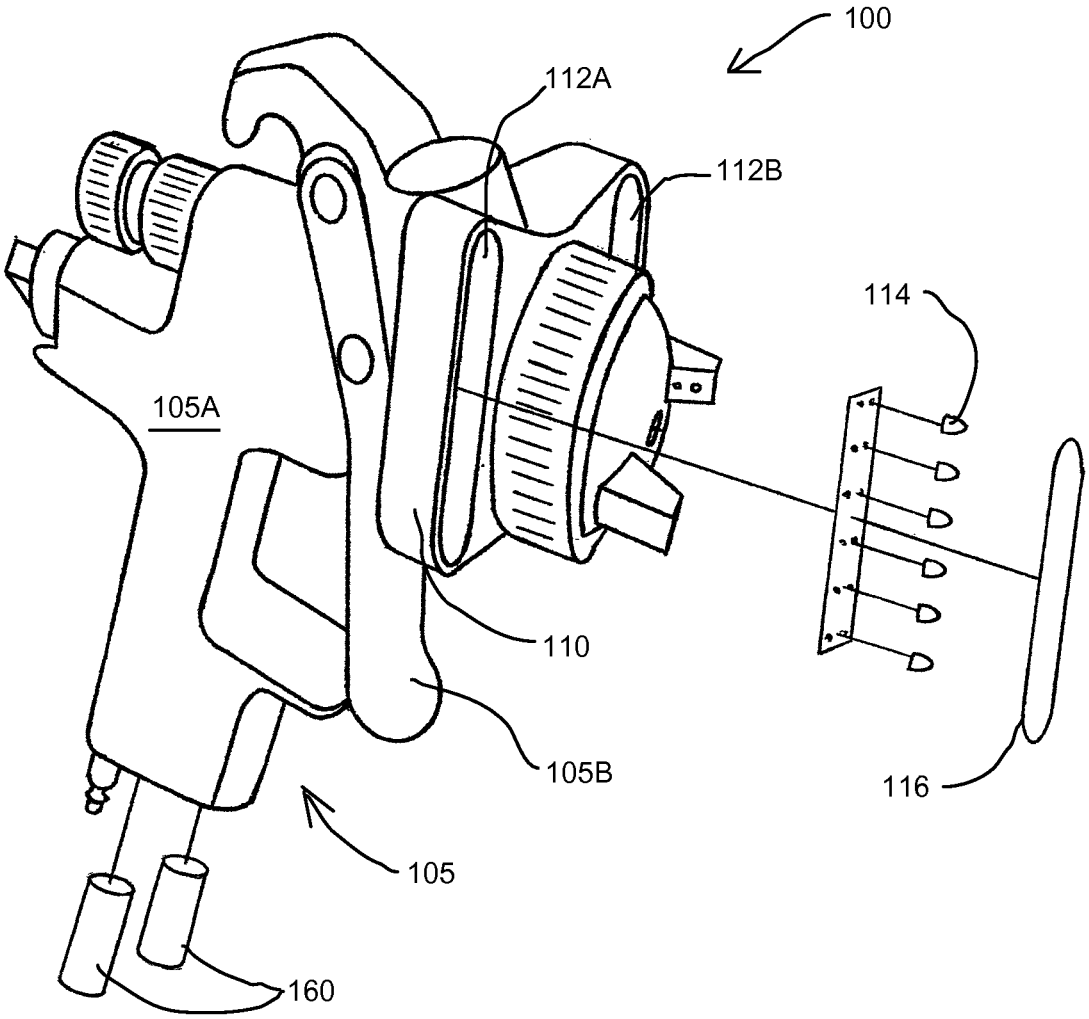
FIG. 5 is perspective view of a second embodiment of a spray paint gun light assembly.
Figure 6:
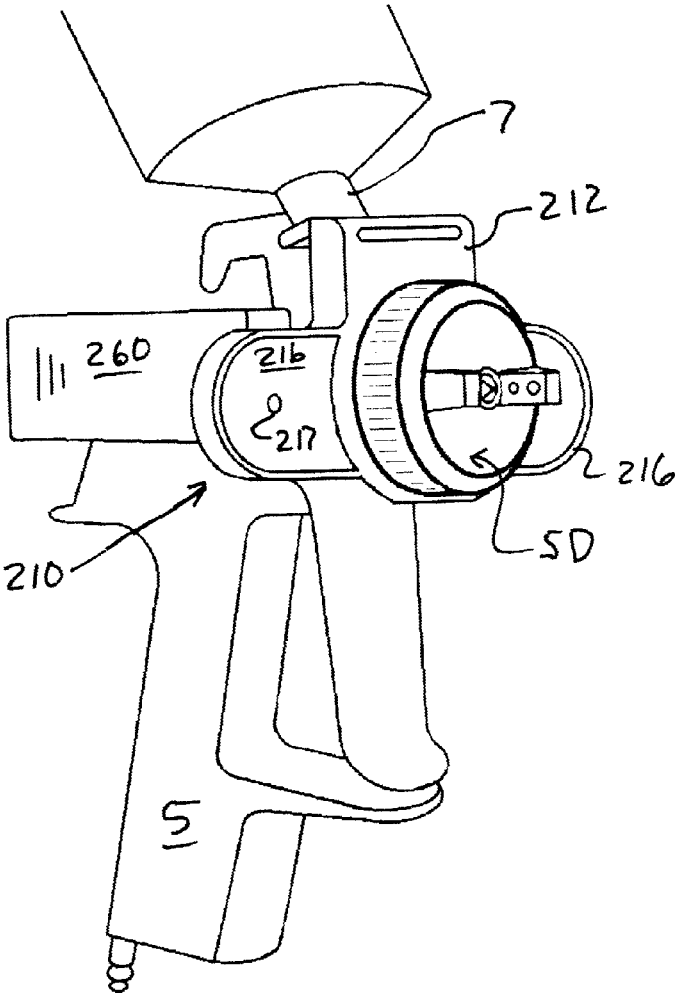
FIG. 6 is a perspective view of a third embodiment of the spray paint gun light assembly.
Figure 7:
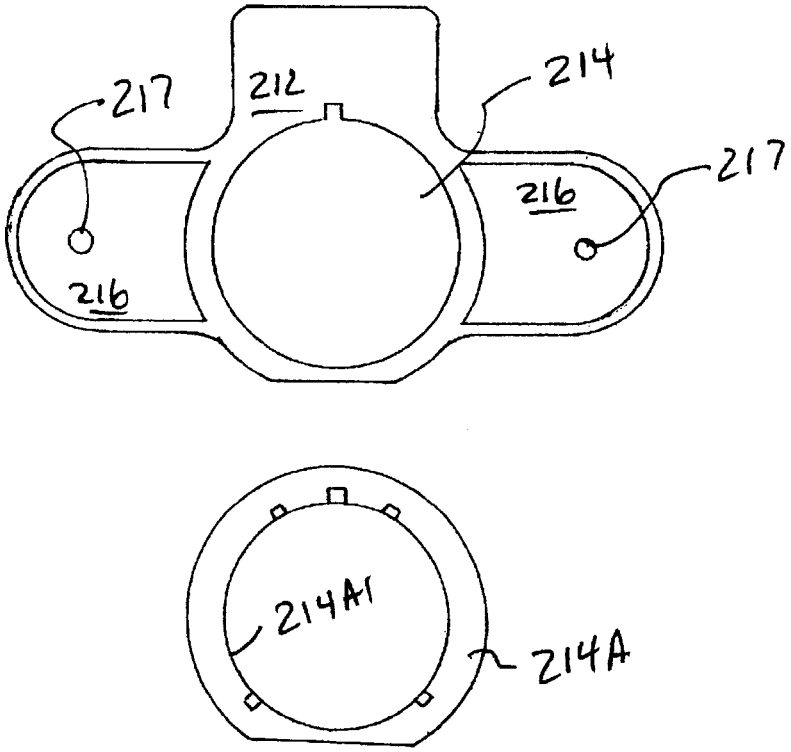
FIG. 7 is a front view of the third embodiment of the spray paint gun light assembly showing a changeable nozzle fitting.
Figure 8:
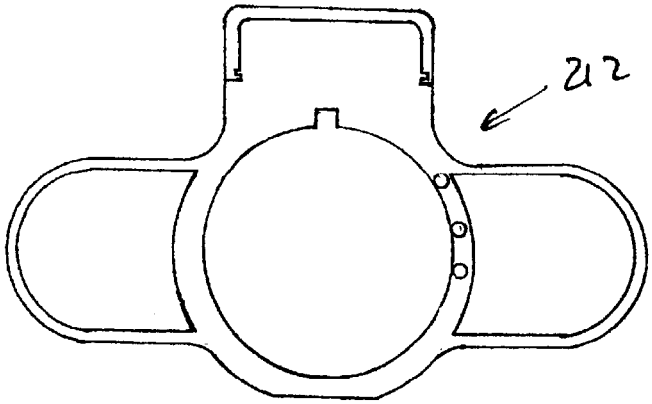
FIG. 8 is a rear view of the third embodiment of the spray paint gun light assembly.
Figure 9:
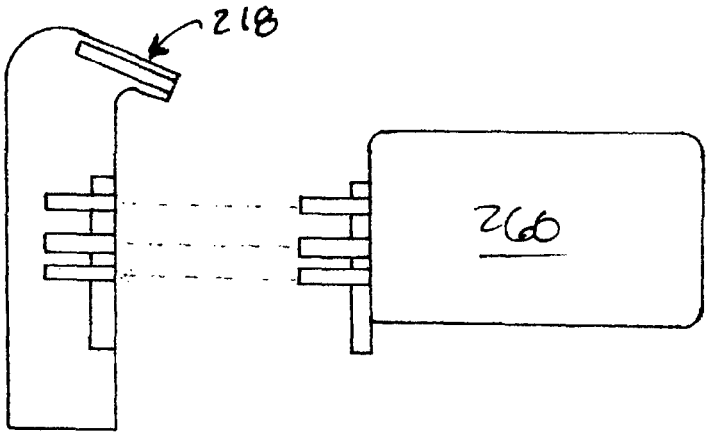
FIG. 9 is a side view of the third embodiment of the spray paint gun light assembly.

FIG. 5 is a partially exploded view illustrates spray gun light assembly 110 which is a second embodiment of the present invention. As can be seen in FIG. 5, the body of gravity fed spray gun 105 a light fitting 111 which has two generally upright side portions 112A and 112B. In FIG. 5, side portion 112A is exploded for illustrative purposes. In this example each side portion 112A or 112B supports six LED lights 114. A transparent light lens 116 protects each pattern of LED lights 114. Preferably, the lights in this example are oriented vertically (or parallel to the longitudinal axis of paint gun 5A) because, generally, the spray pattern is generally vertical. Light fitting 111 may be cast into the body of paint gun 105A or may be an injected molded plastic assembly that shaped to mount to a correspondingly shaped paint gun body. In either case, an open volume in the handle of paint gun body may be used to provide a battery compartment for receiving and holding batteries 160 for powering lights 114. A switch may be integrated such that when trigger 105B is depressed, lights 114 are activated. Preferably, the integrated switch should be arranged such that the light is activated when trigger 105B is only slightly depressed and such that paint is supplied when trigger 105B is depressed to a greater degree. Thus, the painter may illuminate an area prior to applying paint.

FIGS. 6-10 illustrate a third embodiment spray gun light assembly 210. As can be seen in FIG. 5, light assembly 210 includes a body 212 and a battery pack 260 which in this example is fixed to body 212. Body 212 includes a central opening 214 adapted for receiving the nozzle of a paint gun. Body 212 also includes two opposite light modules 216. Preferably, light modules 216 are symmetrically spaced on either side of the paint nozzle in order to not effect the center of gravity of the paint nozzle as much as possible. Also preferably, light modules 216 are positioned behind the spray nozzle so that light is emanating from behind the point were spraying paint originates. In this example, each light module carries one very intense LED light source 217. Preferably, each light source 217 has a light output of about 200 lumens. In this example, two CREE XM-L white LEDs are selected which each have an output of about 200 lumens or a combined output of about 400 lumens. Two such LED lights as used here would have a light output generally comparable to one 40 W incandescent light bulb. The upper part of body 212 presents a paint inlet fitting bracket 218. Paint inlet fitting bracket 218 includes a downwardly and rearwardly sloped flange 224 which presents a notch 226 for bracing body 212 by receiving the paint inlet fitting 7 of a spray gun 5 (or sometimes referred to by those skilled in the art as the lower portion of the paint cup attachment) as described above.

Third embodiment light assembly 210 is designed to mount to different types of paint spray guns having different sized nozzles and differently located and sized paint inlet fittings. This is accomplished by providing two changeable parts which have common interfaces to light assembly 210 but varying interfaces for a particular spray paint gun. The first changeable part is for accommodating various sizes and shapes of paint gun nozzles. Thus, as can be best seen in FIG. 7, central opening 214 of body 212 is fashioned to accept a changeable washer like nozzle fitting 214A. Nozzle fitting 214A is adapted to be received by and to fit opening 214 of body 212. Nozzle fitting 214A has an inside opening 214A1 which is adapted to fit a particular style and size of paint gun nozzle. Thus it is possible to produce one light assembly body 212, while using a plurality of nozzle fittings 214A to accommodate a wide variety of paint gun nozzles.

Figure 10:
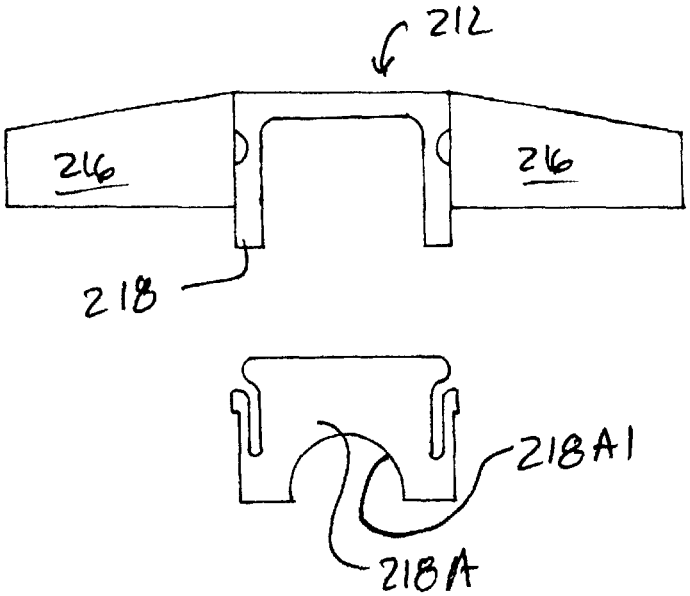
FIG. 10 is a top view of the third embodiment of the spray paint gun light assembly showing a changeable sprayer neck fitting.
Figure 11:
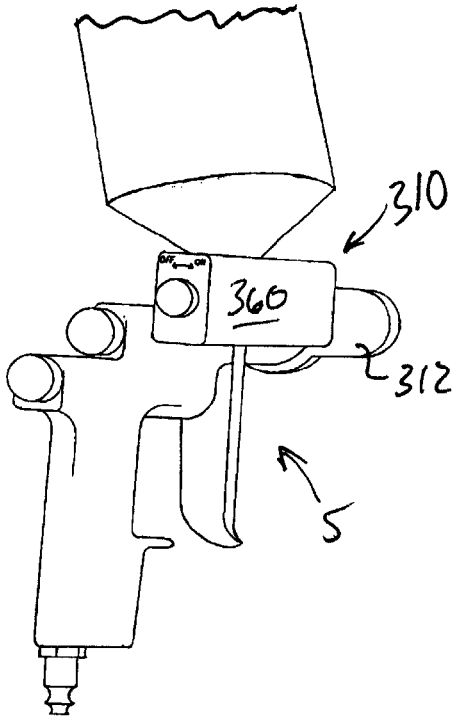
FIG. 11 is a perspective view of the fourth embodiment of the spray paint gun light assembly shown mounted to a paint spray gun.

The second changeable part of light assembly 210 is for accommodating various sizes and shapes of paint guns with respect to the location and placement of the neck portion 5E of a paint container 5C as described above or the paint inlet fitting 7 of a spray gun 5 as described above. Thus, as can be best seen in FIG. 10, which gives a top view light assembly 210, paint inlet fitting bracket 218 includes a removable notch plate 218A which presents a rearward opening notch 218A1. Notch 218A1 is shaped and sized to brace against the inlet fitting 7 of a paint gun 5. As can be seen in FIG. 10, removable notch plate 218A has a common interface with the base of inlet fitting bracket 218 and presents notch 218A1 which can be varied. Thus, by producing a number of different notch plates 218A, it is possible to accommodate a wide variety of spray paint guns. Accordingly, with the combination of changeable nozzle fittings 214 described above and changeable notch plates 218A described immediately above, it is possible to fashion a versatile paint gun light assembly that can fit a wide range of spray paint guns while using only two changeable parts. The above described parts for light assembly 210 are preferably and most economically fashioned from injection molded or 3-D printed plastic but can be fashioned from any other suitable, lightweight sufficiently strong and rigid material.

Accordingly, from the above description, the skilled reader may appreciate how spray paint gun light assemblies 10, 110 and spray paint gun assembly 210, by using compact, light weight LED lights, a compact design that is compactly arranged around the spray nozzle of the spray gun, provides a useful device for illuminating a surface being painted.

Figure 12:
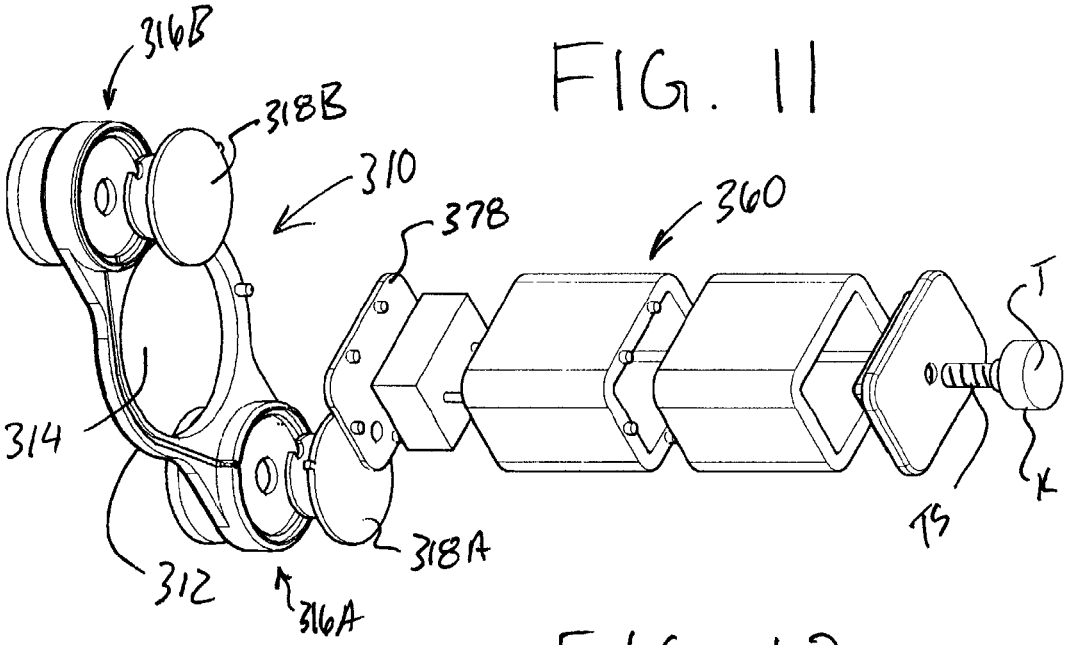
FIG. 12 is a perspective exploded view of the fourth embodiment of the spray paint gun light assembly.

FIGS. 11-16B illustrate a fourth embodiment spray gun light assembly 310. As can be seen in FIG. 5, light assembly 310 is very much like third embodiment spray gun light assembly 210 described above. Light assembly 310 includes a light assembly body 312 and a battery pack 360 which in this example is fixed to body 312. As can be seen in FIG. 12, battery pack 360 includes an end plate 378 which, in this example, is fixed to a light module back plate 318A of light assembly body 312. End plate 378 and light module back plate 318A may be consolidated as one part so that end plate 378 and end back plate 318 comprise one injected molded plastic part. Body 312 includes a central opening 314 adapted for receiving a nozzle 5D of a paint gun. Body 312 also includes two opposite light modules 316A and 316B which are preferably evenly and symmetrically spaced from the center of opening 314. Light modules 316A and 316B present lights 316L1 and 316L2 respectively which, like light modules 316A and 316B, are also preferably evenly and symmetrically spaced from the center of opening 314. Light modules 316A and 316B are symmetrically spaced on either side of opening 314 and paint nozzle 5 in order to minimize the effect of light assembly 310 on the center of gravity and balance of paint gun 5 and to project guide shadows as will be described below.

Figure 15:
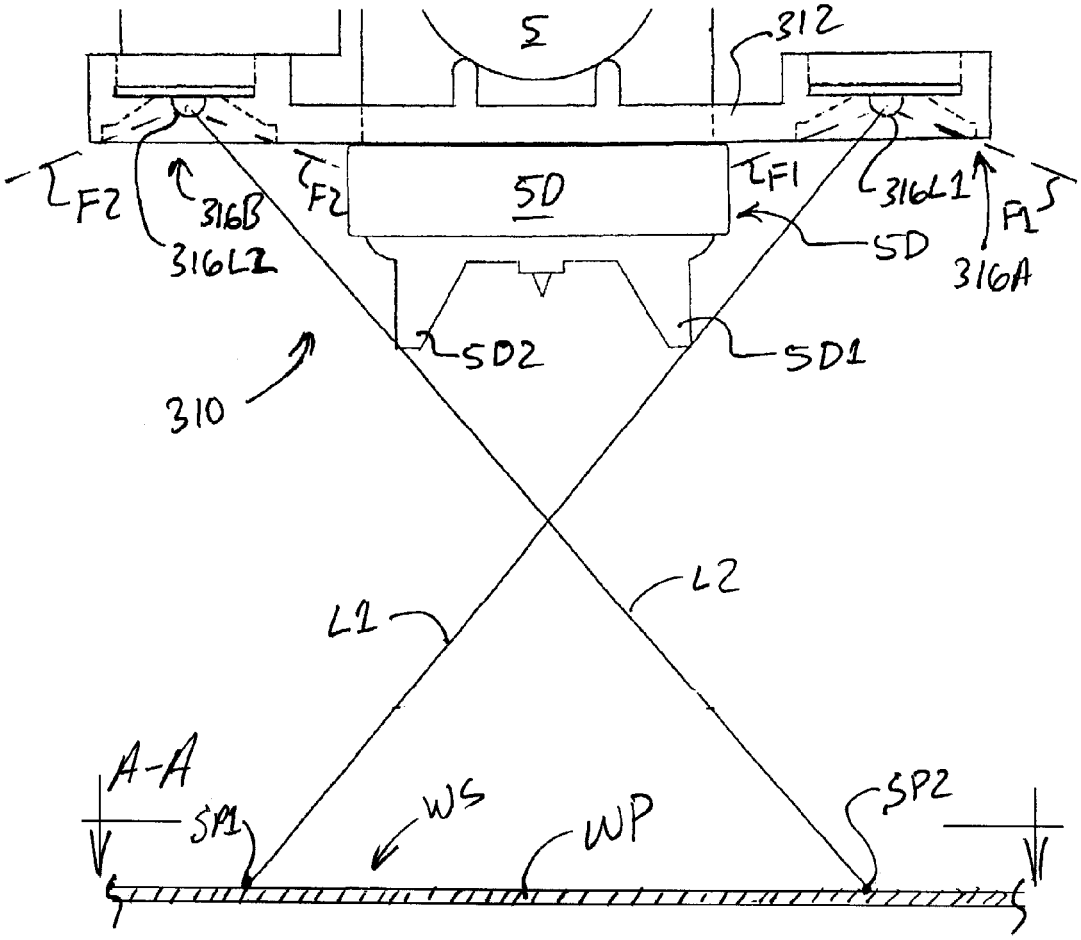
FIG. 15 is a side view showing a spray gun with a fourth embodiment spray gun light assembly in relation to a workpiece WP which is being painted.

As can be seen in FIG. 15, in this example, light modules 316 are also positioned behind spray nozzle 5D so that light is emanating from the light sources 316L1 and 316L2 of light modules 316A and 316B from behind the point were spraying paint originates and so that the light emanating from lights 316L1 and 316L2 causes prong shadows 5S1 and 5S2 respectively to be cast by spray nozzle prongs 5D1 and 5D2 respectively. The nature and use of prong shadows 5S1 and 5S2 will be described in greater detail below. The structural components of light assembly body 312, in this example, are fashioned from injected molded plastic or possibly even 3-D printed plastic or some other convenient, equivalent material.

Light sources 316L1 and 316L2 are preferably small, concentrated, intense light sources. Light sources 316L1 and 316L2 are preferably not large and diffuse in nature. Preferably, each light source 316L1 and 316L2 has a light output of about 200 lumens. In this example, two CREE XM-L white LEDs are selected which each have an output of about 200 lumens or a combined output of about 400 lumens. Such an LED light is relatively small and behaves much like a point light source, which is preferred for this device. As can be seen in FIG. 15, in this example, light sources 316L1 and 316L2 are positioned at the center of relatively shallow conical depressions which are defined in light modules 316A and 316B respectively. With this arrangement, light sources 316L1 and 316L2 cast a wide field of illumination as indicated by illumination limit lines F1 and F2. The applicant believes it is preferable to cast light in a wide field so that the painter may have a relatively large area of work surface WS illuminated. Two such LED lights as used in this example which have a combined light output of about 400 lumens would generally be comparable in intensity to one 40 W incandescent light bulb. The color of light emanating from such LED lights would be consistent with a light source at 4600 degrees Kelvin, a color which is generally comparable to light cast on a surface in bright sunlight at mid-day during the summer months in the northern (or southern) latitudes.

Figure 13:
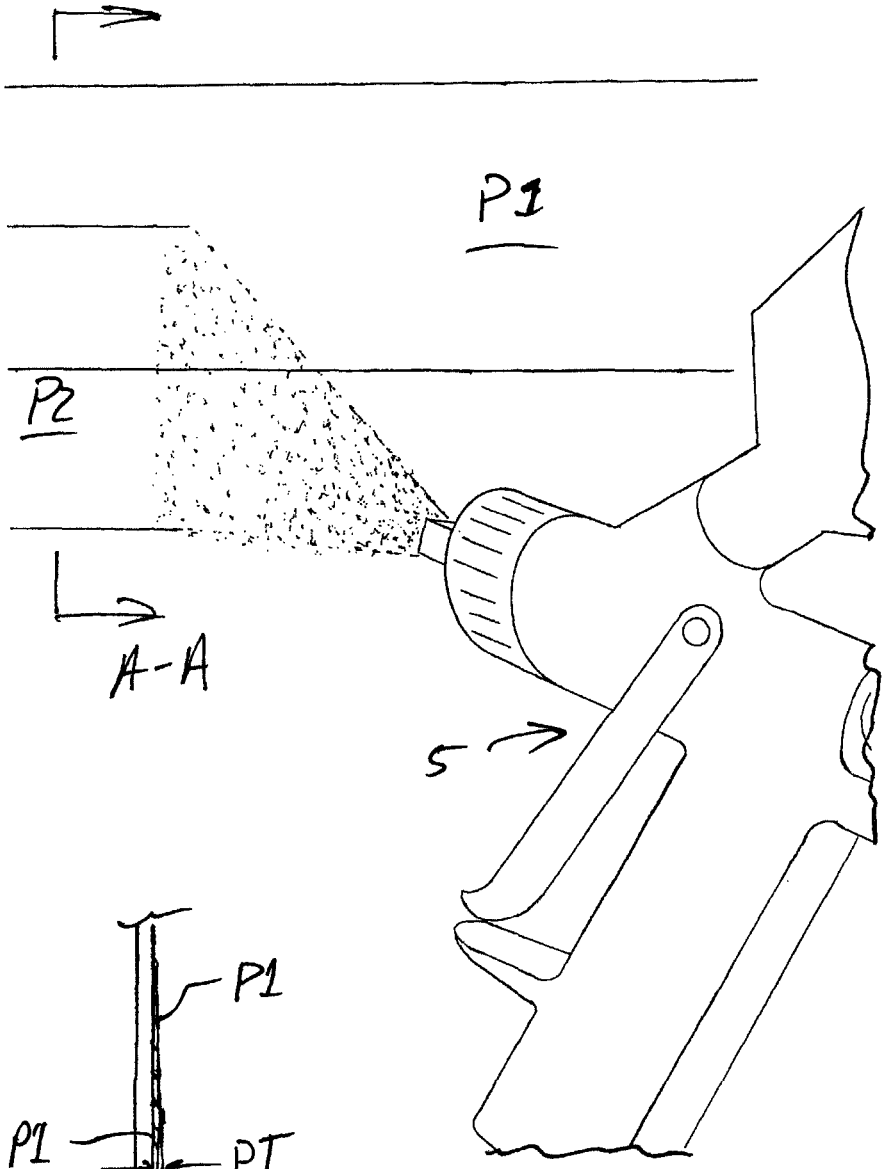
FIG. 13 is a perspective view showing a spray paint gun spraying paint on a surface.
Figure 14:
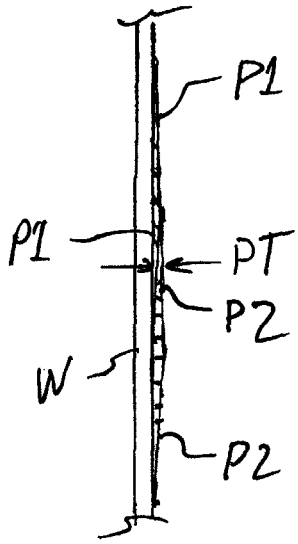
FIG. 14 is a section view taken from plain A-A indicated in FIG. 13.

An important aspect of third embodiment spray gun light 210 and fourth embodiment spray gun light 310 is the projection of spray nozzle prong shadows to indicate the center of the spray pattern. Typically, a paint spray gun 5 will be operated to deposit an elongated zone of paint P1 as shown in FIG. 13. Accepted practice is to deposit a first zone of paint P1 and then to deposit a second overlapping zone of paint P2 as shown in FIG. 13. This is accomplished by moving the spray gun at a generally constant rate and at a generally constant distance from that work surface W while holding the spray gun in generally constant normal orientation with respect to the work surface W. The proper overlap is accomplished when laying down second zone P2 by maintaining the center of the spray pattern at the edge of the previous zone P1. The desired result is shown in FIG. 14 that is a cross section taken plane A-A of FIG. 13. As can be seen in FIG. 14, both first and second zones P1 and P2 taper toward the upper and lower edges. However, where zones P1 and P2 overlap on work surface W, they have a generally uniform thickness PT. It is this generally uniform thickness that is the desired result for the skilled painter.

The use of spray gun prong shadows 5S1 and 5S2 to guide the deposition of a paint zone is illustrated in FIG. 15. Recall that spray gun prongs 5D1 and 5D2 protrude from the spray gun nozzle as 5D shown in FIG. 15 and also as shown FIGS. 1, 5 and 6 for typical spray paint gun nozzles. Also recall that light sources 316L1 and 316L2 are located on either side in a symmetrical fashion and behind spray gun nozzle 5D as shown in FIG. 15. The skilled reader should note the angle formed by a line passing through the center of one of light sources 316L1 or 316L2 and the nearest prong 5D1 or 5D2, in this example, forms approximately a 45 degree angle with the plane of light assembly 312. In FIG. 15, a workpiece WP is shown in cross section. Workpiece WP has an upper surface WS that is being painted by spray gun 5. Although paint is being sprayed from paint gun 5 it is not shown in FIG. 15 for clarity and ease of illustration. A typical spray pattern may be seen in FIG. 13. Line L1 indicates a line between light source 316L1 and the tip of prong 5D1. Line L1 terminates on workpiece W at point SP1. Line L2 indicates a line between light source 316L2 and the tip of prong 5D2. Line L2 terminates on workpiece W at point SP2. Although spray nozzle prongs 5D1 and 5D2 are used in this example to provide prongs for casting guide shadows, the skilled reader should appreciate that if prongs 5D1 and 5D2 are not present or if they are oriented differently, shadow casting elements could be easily added to light assembly 310 at locations very proximate to light sources 316L1 and 316L2 which are adapted to cast guide shadows that may be used by a painter in the manner described in detail below. (The distance shown in FIG. 15 between light assembly body 312 and work surface WS is not to scale for ease of illustration. Normally this distance might be about twice the width of light assembly body 312 and points SP1 and SP2 might be more widely spaced on work surface WS.)

Figure 15A:
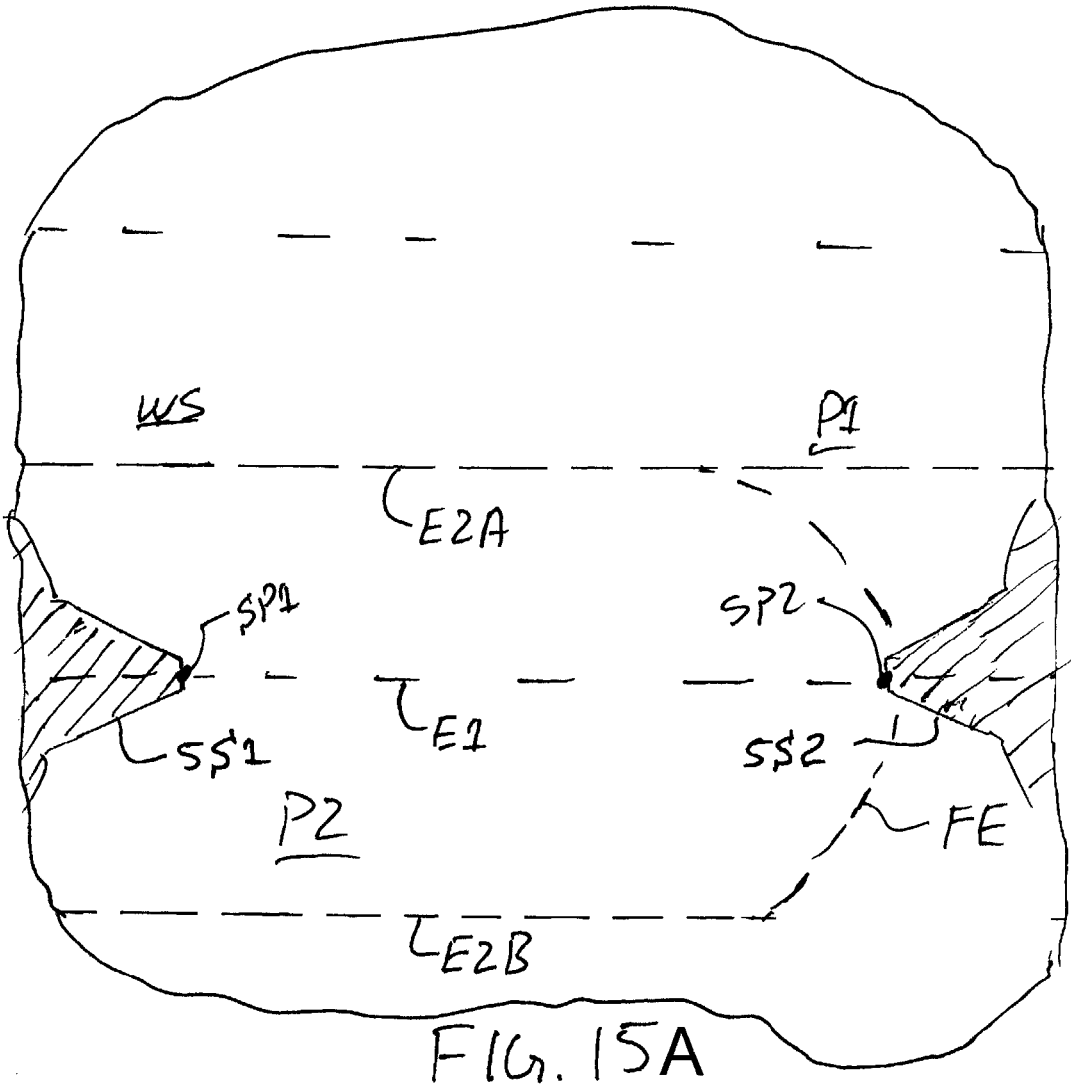
FIG. 15A is a plan view of the workpiece shown in FIG. 15 taken from plane A-A indicated in FIG. 15 which shows spray pattern position indicator shadows on a work surface when the fourth embodiment spray gun light is used to illuminate the work surface.

FIG. 15A is a plan view of workpiece WP showing work surface WS. As can be seen in FIG. 15A, a first spray paint zone P1 having a lower edge E1 is deposited on work surface WS. In FIG. 15A, a second pattern P2 is being deposited on surface WS. The skilled reader should note the forward edge FE of the second spray pattern. Further, second spray pattern P2 has an upper edge E2A and a lower edge E2B. It can be seen in FIG. 15A that two prong shadows 5S1 and 5S2 can be seen on surface WS. Prong shadows 5S1 and 5S2 may be thought of as spray pattern position indicator shadows. They indicate the centerline of the spray pattern as long as the operator tends to move the spray gun in a direction that is aligned with points SP1 and SP1, or prongs 5D1 and 5D2, or light sources 316L1 and 316L2. Shadows 5S1 and 5S2 are positioned according to the locations of points SP1 and SP2. Points SP1 and SP2 and lines L1 and L2 are merely geometric projections which are being used for illustrative purposes and would not be visible to the user of a spray gun having light assembly 316. Shadows 5S1 and 5S2 however would be visible to the painter. FIG. 15A shows shadows 5S1 and 5S2 are preferably aligned with edge E1 of first paint zone P1 as the spray paint gun is moved relative to surface WS as described above. When paint gun 5 is operated to cause shadows 5S1 and 5S2 to track along edge E1 of a proceeding zone of paint, then the overlap of paint zones P1 and P2 will be approximately correct, and, by extension, the thickness of the deposited paint will be approximately uniform if other aspects of good painting technique have been followed. Thus light assembly 316 is arranged to project spray pattern position indicator shadows 5S1 and 5S2 which can be used by a skilled painter to follow the edge of a previous pass to more reliably deposit uniform layers of paint on a work surface.

Figure 16B:
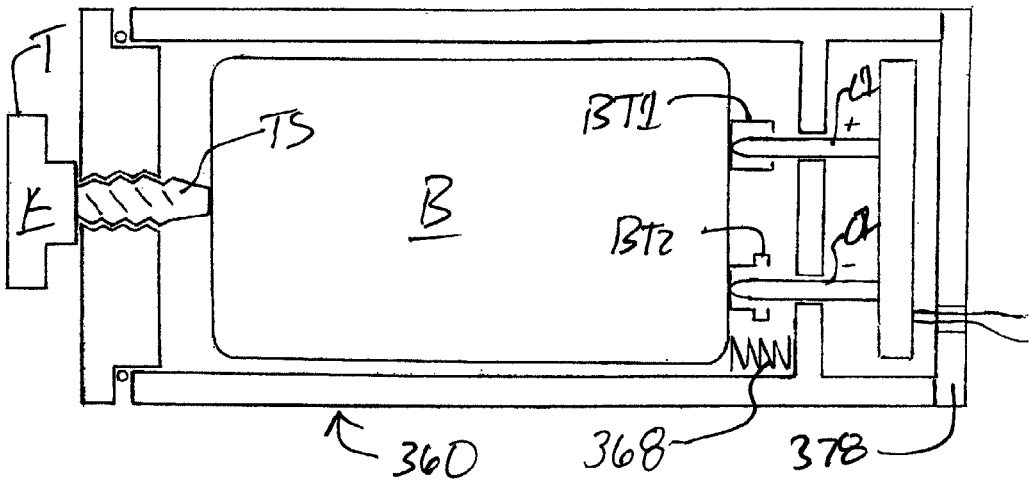
FIG. 16B is a cross section view of the battery compartment of the fourth embodiment spray gun light showing the light circuit in the on position.
Figure 16A:
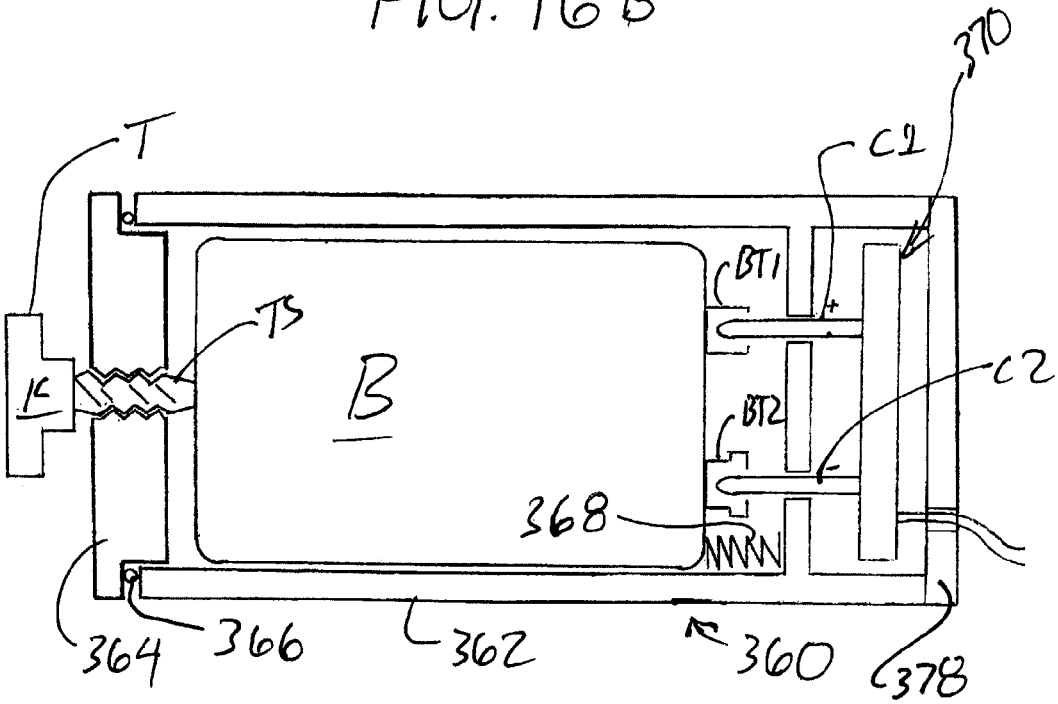
FIG. 16A is a cross section view of the battery compartment of the fourth embodiment spray gun light showing the light circuit in the off position.

Another aspect of fourth embodiment light assembly 310 is the battery compartment 360 shown in FIGS. 16A and 16B. An important aspect of battery module 360 is to provide a battery compartment and switching mechanism that cannot be effected by spray paint. Typically, spray paint would tend to accumulate and foul devices with a conventional switch. As can be seen in FIG. 16A, battery B, which, in this example, is a typical compact nine volt battery, is enclosed in water tight compartment 362. Battery module 360 also includes a switch mechanism 370. Compartment 362 is closed by a sealed cap 364 which, in this example, is sealed by an O ring 366. As can be seen in FIGS. 16A and 16B, battery B is capable of sliding between a non-contact position shown in FIG. 16A and a contact position shown in FIG. 16B. When in the non-contact position, battery terminals BT1 and BT2 are not in contact with light circuit contacts C1 and C2 respectively. A spring 368 biases battery B in the non-contact position. A thumb screw T presents a knob K and a threaded portion TS which extends through a correspondingly threaded opening which is located oppositely from the terminals BT1 and BT2 and spring 368. When thumb screw T is turned to cause threaded portion TS to extend through cap 364, battery B is urged against spring 368 and urged into the contact position shown in FIG. 16B. Thus, battery module 360 provides a sealed switch that is highly resistant to the infiltration of paint or solvents. The structural parts of battery module 360 comprising the closed compartment are most easily fashioned from injection molded plastic or 3-D printed plastic. Other components such as the spring, the switch mechanism or any electrical converters and the like needed to transfer power from a standard compact battery such as the standard 9V battery shown (or other selected readily available batteries) to selected light sources 316L1 and 316L2 are be well known to those skilled in the art.

Figure 17:
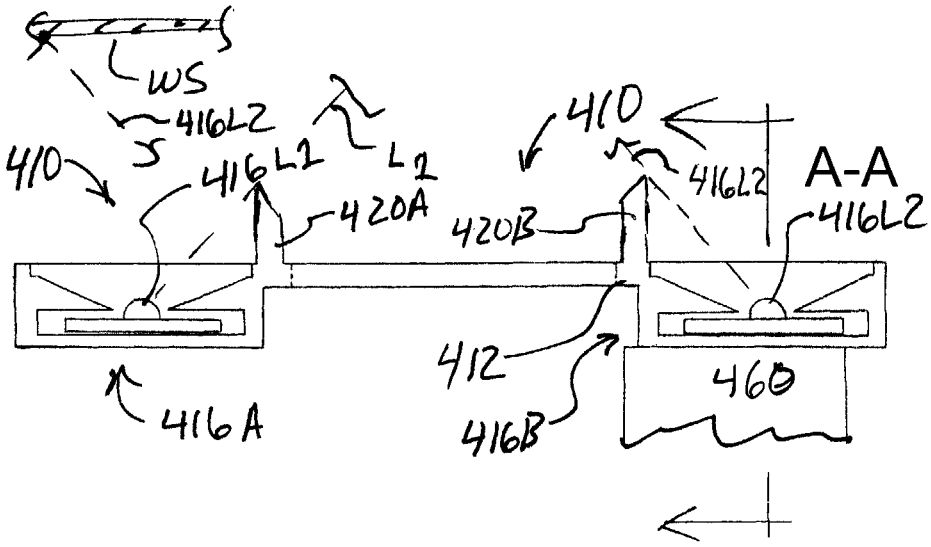
FIG. 17 is a top view of a fifth embodiment of the spray gun light assembly.
Figure 17A:
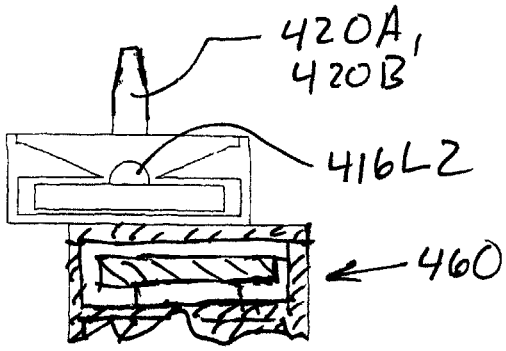
FIG. 17A is a cross section view of the fifth embodiment of the spray gun light assembly taken from plain A-A of FIG. 17.

FIGS. 17 and 17A illustrate a fifth embodiment 410 of the paint gun light. Fifth embodiment light assembly includes a light assembly body 412. In this example, light assembly body 412 may be identical to light assembly body 312, except, fifth embodiment light assembly body 412 presents two oppositely spaced, symmetrical shadow prongs 420A and 420B. Shadow prongs 420A and 420B are located inboard of light sources 416L1 and 416L2 and project toward the work surface WS as shown in FIG. 17. (The distance shown in FIG. 17 between light assembly body 412 and work surface WS is not to scale for ease of illustration. Normally this distance might be about twice the width of light assembly body 412.) FIG. 17A provides a side view of shadow prongs 420A and 420B. In this example, shadow prongs 420A and 420B are shaped to cast shadows on work surface WS that might be somewhat similar to those shown in FIG. 15A. It is important that the shadows cast by shadow prongs 420A and 420B be sufficiently clear and defined to allow a painter to understand the location of the centerline of the zone wherein paint is being deposited on work surface WS. Shadow prongs 420 are useful if it is desirable to mount light assembly 410 at a location that is forward of that shown in FIG. 15 or if a spray nozzle is in use that does not present prongs 5D1 and 5D2 shown in FIG. 15.

As can be understood from the above description, light assemblies 210, 310 and 410 provide a compact intense paint spray gun light which illuminate large areas of a work surface. Light assemblies 210, 310 and 410 also provide a way for a painter to track the location of the center of a spray paint zone. This makes it easier for the painter to align the center of a spray pass with the edge of a previous pass. By so doing, the painter is not only able to see his or her work more clearly because of the wide and relatively intense field of illumination but he or she is able to deposit more uniform layer of paint as the work progresses. This leads the optimized, uniform deposition of paint.

It is to be understood that while certain forms of this invention have been illustrated and described, it is not limited thereto, except in so far as such limitations are included in the following claims and allowable equivalents thereof.

The invention claimed is:

1. A light assembly for use with a spray paint gun of the type having a spray gun body and a spray nozzle assembly including a nozzle fitting and a removable spray nozzle that threads onto the nozzle fitting wherein the nozzle fitting presents two evenly and symmetrically spaced outwardly extending prongs positioned laterally on either side of the nozzle fitting, the light assembly comprising:

(a) a light assembly body having an opening for receiving the nozzle fitting of the spray nozzle assembly such that when the light bracket receives the nozzle fitting and the spray nozzle is threaded onto the nozzle fitting, the light assembly body being mounted on the spray gun body, (b) light modules fixed on either side of the light assembly body such that each light module presents a light source, the light modules positioned such that when the light assembly body is mounted to the spray nozzle, the light sources are spaced away from the spray nozzle prongs and behind the spray nozzle prongs, such that when the light sources are activated, the nozzle prongs obstruct some of the light emanating from the light sources to cause guide shadows to be cast on a work surface, (c) an electrical power source in communication with the light sources and a switch operable for selectively providing electrical power to the light sources.

2. The light assembly of claim 1, wherein:

the light sources are LED lights.

3. The light assembly of claim 1, wherein:

the light sources are LED lights having a combined brightness of at least 200 lumens.

4. The light assembly of claim 1, wherein:

shadow casting elements are fixed to the light modules for casting guide shadows on a work surface to guide the deposition of sprayed paint.

5. The light assembly of claim 1, wherein:

a battery module is mounted to the light assembly.

6. The light assembly of claim 5, wherein:

the battery module includes a sealed battery compartment for enclosing a battery having two terminals and wherein the battery compartment includes a spring for biasing the battery in a first non-contact position and wherein a threaded portion extending between the exterior and interior of the compartment engages the battery and is operable to translate the battery against the spring bias to a contact position in which both terminals of the battery come in contact with a circuit connected to the light assembly for providing electric power to the light sources.

7. A light assembly for use with a spray paint gun of the type having a spray gun body and a spray nozzle assembly including a nozzle fitting and a removable spray nozzle that threads onto the nozzle fitting, the light assembly comprising:

(a) a light assembly body having an opening for receiving the nozzle fitting of the spray nozzle assembly such that when the light bracket receives the nozzle fitting and the spray nozzle is threaded onto the nozzle fitting, the light assembly body being mounted on the spray gun body, (b) opposite light modules fixed on either side of the light assembly body, each light module presenting a light source, the light modules also presenting shadow prongs which are spaced away from the light sources and which project away from the spray gun, such that when the light sources are activated, the shadow prongs obstruct some of the light emanating from the light sources to cause guide shadows to be cast on a work surface, (c) an electrical power source in communication with the light sources and a switch operable for selectively providing electrical power to the light sources.

8. The light assembly of claim 7, wherein:

the light sources are LED lights.

9. The light assembly of claim 7, wherein:

the light sources are LED lights having a combined brightness of at least 200 lumens.

10. The light assembly of claim 7, wherein:

a battery module is mounted to the light assembly.

11. The light assembly of claim 10, wherein:

the battery module includes a sealed battery compartment for enclosing a battery having two terminals and wherein the battery compartment includes a spring for biasing the battery in a first non-contact position and wherein a threaded portion extending between the exterior and interior of the compartment engages the battery and is operable to translate the battery against the spring bias to a contact position in which both terminals of the battery come in contact with a circuit connected to the light assembly for providing electric power to the light sources.

* * * * *